United States Patent [19]

Perkins, Jr. et al.

[11] 3,976,894

[45] Aug. 24, 1976

[54] ANALOG DIVIDER CIRCUITRY

[75] Inventors: John F. Perkins, Jr., Bedford; Ilmars Leja, Dracut, both of Mass.

[73] Assignee: Raytheon Company, Lexington, Mass.

[22] Filed: Feb. 3, 1975

[21] Appl. No.: 546,374

[52] U.S. Cl. ..... 307/229; 307/251; 328/161; 328/127

[51] Int. Cl.[2] ..... G06G 7/12; G06G 7/16

[58] Field of Search ..... 328/161, 162, 127; 307/229

[56] References Cited

UNITED STATES PATENTS

| | | | |
|---|---|---|---|
| 3,473,043 | 10/1969 | James | 328/161 |
| 3,686,513 | 8/1972 | Miller | 328/161 |
| 3,845,398 | 10/1974 | Katz | 328/127 |

OTHER PUBLICATIONS

Electronics, Building Blocks are Two–Base Hit for Analog Control Computer by E. Segarra & J. Perkins D6, Aug. 4, 1969.

*Primary Examiner*—Stanley D. Miller, Jr.
*Assistant Examiner*—B. P. Davis
*Attorney, Agent, or Firm*—Richard M. Sharkansky; Philip J. McFarland; Joseph D. Pannone

[57] ABSTRACT

An analog divider network is disclosed wherein an operational amplifier includes a feedback impedance coupled between an input terminal and output terminal of such amplifier through a switching network. The input terminal of such amplifier is coupled to the "numerator" analog signal applied to the analog divider network. Means are provided for actuating the switching network to periodically decouple the feedback impedance from the input and output terminals for a time duration inversely proportional to the magnitude of the "denominator" analog signal, thereby to provide an output signal proportional to the ratio of the "numerator" analog signal to the "denominator" signal.

3 Claims, 5 Drawing Figures

TIME
VOLTAGE
0
-1
-3
-4
51
50

TIME
ON/OFF CONDITION FIELD EFFECT TRANSISTOR,34
ON
OFF
ON
OFF
ON
OFF

TIME
ON/OFF CONDITION FIELD EFFECT TRANSISTOR,34
ON
OFF
ON
OFF
ON
OFF
$V_o$
$\Delta_F$
$\Delta_R$
54

TIME
VOLTAGE
$V_o$
56

ANALOG DIVIDER CIRCUITRY

BACKGROUND OF THE INVENTION

This invention pertains generally to analog divider circuitry and more particularly to circuitry of such type which is adapted to operate with analog signals having relatively large dynamic ranges.

As is known in the art, it is sometimes required to divide the level of one analog signal by the level of a second analog signal, as in the normalization of the azimuth and elevation signals in a monopulse radar receiver when such signals are divided by the sum signal of such receiver. One known approach used to accomplish such normalization contemplates the use of automatic gain controlled (AGC'd) amplifiers disposed in the azimuth and elevation channels, the gain of such amplifiers being controlled by signals produced in accordance with the level of the signal in the sum channel. While such technique has been found to be adequate in many applications, it has been found generally to be inadequate where the levels of the signals involved in the normalization or division process have a relatively wide dynamic range, say in the order of 60 db or more.

Another type of normalization is performed by the use of so-called logarithmic dividers. Here signals are developed representative of the logarithms of the "numerator" analog signal and the "denominator" analog signal. The "logarithm" signals are passed to a differencing network and then to a so-called "antilogarithm" amplifier to complete the division process. While such logarithmic dividers have also been found to be adequate in many applications, the accuracy of such dividers may degrade to an unacceptable level when the magnitude of the numerator signal is very close to the magnitude of the denominator signal. When such a condition exists, the antilogarithm amplifier is actuated by relatively small level input signals with a concomitant reduction in sensitivity. Further, such logarithmic dividers generally require that both the numerator signal and the denominator signal be of the same polarity, thereby limiting the applications in which such devices may be used.

SUMMARY OF THE INVENTION

With this background of the invention in mind it is an object of this invention to provide an improved analog divider network.

This and other objects of the invention are attained generally by providing an analog divider network comprising an operational amplifier having a feedback impedance coupled between an input terminal and an output terminal of such amplifier through a switching network; and, means for actuating such switching network to periodically decouple the feedback impedance from the input terminal and output terminal for a time duration inversely proportional to the magnitude of one of a pair of analog signals. With such an arrangement the divider network operates to divide (or to normalize) an analog signal applied to the operational amplifier by the analog signal which actuates the switching network.

BRIEF DESCRIPTION OF THE DRAWINGS

For a more complete understanding of the concepts of the invention reference is now made to the following description of embodiments of the invention illustrated in the accompanying drawings, in which.

DESCRIPTION OF THE PREFERRED EMBODIMENT

Figure 1:
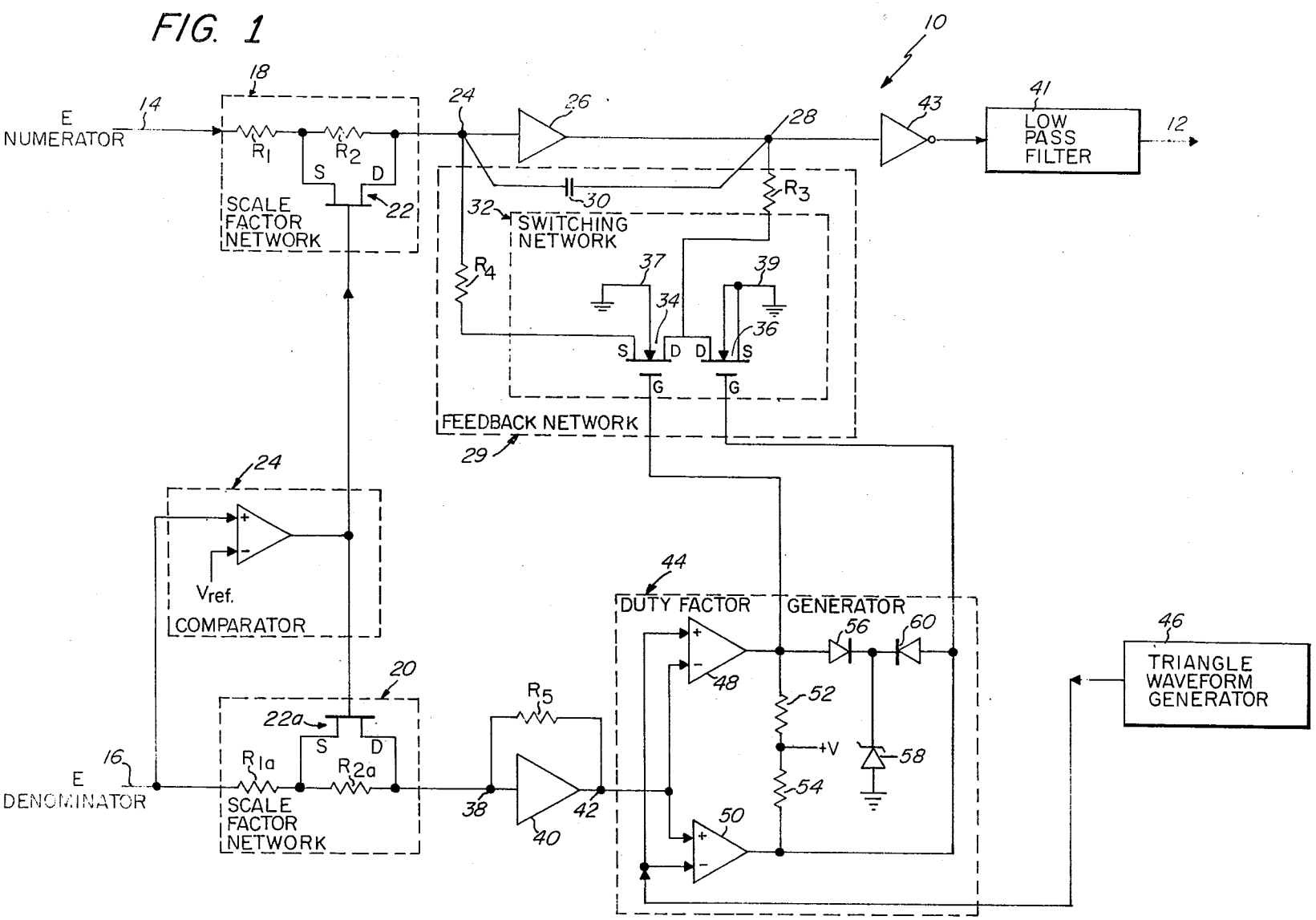
FIG. 1 is a block diagram of an analog divider network according to the invention.

Referring now to FIG. 1, analog signal divider network 10 is shown. Such divider network 10 produces an output signal on line 12 which is proportional to the ratio of the level of the signal on input line 14 to the level of the signal on input line 16. That is, input signals on lines 14 and 16 may be viewed respectively as the "numerator signal" and "denominator signal" which are applied to the divider network 10.

The signals on lines 14 and 16 are passed to scale factor networks 18 and 20 respectively as shown. Here such scale factor networks 18 and 20 include serially connected resistors $R_1$, $R_2$, $R_{1a}$, $R_{2a}$ as shown (where $R_1$ equals $R_{1a}$ and $R_2$ equals $R_{2a}$). The resistors $R_2$, $R_{2a}$ are shunted by the source (S) and drain (D) electrodes of conventional field effect transistors (FET's) 22, 22*a*. Input line 16 is coupled to the gate (G) electrodes of the field effect transistors 22, 22*a* through a conventional comparator network 24 as shown. Such comparator network 24 has coupled to a second input thereof a reference voltage here indicated as $+V_{ref}$. In operation, when the level of the signal on input line 16, i.e. the level of the denominator signal, is equal to, or less than, the predetermined reference voltage $V_{ref}$, the field effect transistors 22, 22*a* are made conductive, to effectively connect the source (S) and drain (D) electrodes and to provide short circuits across resistors $R_2$, $R_{2a}$.

The scale factor network 18 is coupled to an input terminal 24 of a conventional operational amplifier 26. The operational amplifier 26 has an output terminal 28. The input terminal 24 and output terminal 28 are interconnected through a negative feedback network 29 here having two parallel feedback paths. One of such paths includes a capacitor 30 and the other includes a first resistor $R_3$, a second resistor $R_4$ and a switching network 32, as shown. The switching network 32 includes two field effect transistors 34 and 36. Here field effect transistors 34 and 36 are each an SD200 manufactured by Signetics, Sunnyvale, California 94086. The resistor $R_3$ has one electrode coupled to output terminal 28 and the other electrode coupled to a junction common with the drain (D) electrode of the field effect transistors 34, 36. Resistor $R_4$ has one electrode coupled to input terminal 24 and the other electrode coupled to the source (S) electrode of the field effect transistor 34. The source (S) electrode of the field effect transistor 36 is connected to ground as shown. The substrate and case (not shown) of field effect transistors 34, 36 are grounded as indicated by lines 37, 39, respectively. The output terminal 28 is coupled to the output terminal 12 through a low pass filter 41 and inverting amplifier, 43, as shown.

The output of scale factor network 20 is coupled to an input terminal 38 of a conventional operational amplifier 40. An output terminal 42 of such amplifier 40 is coupled to the input terminal 38 through a resistor $R_5$ to form a negative feedback path around the operational amplifier 40. The output of operational amplifier 40, i.e. output terminal 42, is coupled to a duty factor generator 44. Also coupled to such duty factor generator 44 is a conventional triangular waveform generator 46. Such triangular waveform generator 46 may include a square wave generator, the output of which is serially coupled to an integrator to thereby produce at the output thereof a triangular shaped voltage waveform.

Duty factor generator 44 includes a pair of conventional comparators 48 and 50. Triangular waveform generator 46 is coupled to the + label terminal of comparator 48 and a − label terminal of comparator 50. The output of operational amplifier 40 is coupled to the − label terminal of comparator 48 and the + label terminal of comparator 50. The outputs of comparators 48 and 50 are coupled to a +V voltage source through resistors 52 and 54 as shown. Further, the output of the comparator 48 is coupled to the gate (G) electrode of the field effect transistor 34 and to ground through a diode 56 and a zener diode 58, as shown. The output comparator 50 is connected to the gate (G) electrode of field effect transistor 36 and to ground through a diode 60 and a zener diode 58, as shown.

In operation when the signal level at terminal 42 is equal to, or more negative than, the level of the signal produced by the triangle waveform generator 46 the signal at the output of comparator 48 goes "high" and the signal at the output of comparator 50 goes "low". In such condition current flows through diode 56 and zener diode 58, thereby to turn field effect transistor 34 to an "on" condition and field effect transistor 36 to an "off" condition. When transistor 34 is in an "on" condition resistors $R_3$ and $R_4$ become coupled through the source (S) and drain (D) electrodes of such transistor to complete the second feedback path around operational amplifier 26. Conversely, when the level of the signal at terminal 42 is less negative than the triangle waveform generator's output signal the output of comparator 48 goes "low" and the signal at the output of comparator 50 goes "high". In such condition current flows through diode 60 and zener diode 58 thereby to turn field effect transistor 34 to an "off" condition and field effect transistor 36 to an "on" condition. Consequently, resistors $R_4$ and $R_3$ become decoupled from each other and the second feedback path around operational amplifier 26 is broken. Resistor $R_3$ is, under such condition, coupled to ground through the source (S) and drain (D) electrodes of transistor 36. It is noted, however, that the capacitor 30 still remains coupled in feedback relationship around amplifier 26.

Before discussing the operation of the analog divider network 10 and the waveform shown in FIGS. 2A to 2D it should first be pointed out that as is known in the art an operational amplifier having an input impedance $Z_1$ and a feedback impedance $Z_2$ may be characterized as having a transfer function $Z_T$ relating the signal produced at the output of the amplifier to the signal applied to the input to such amplifier of the form:

$$Z_T = -Z_2/Z_1$$

It is first pointed out that the impedance of the scale factor networks 18, 20 (which here may be considered to define the input impedances to the operational amplifiers 26 and 40) will be $R_1 + R_2$ and $R_{1a} + R_{2a}$, respectively, when the level of the denominator signal on input line 16 is greater than $+V_{ref}$ and will be $R_1$ and $R_{1a}$, respectively, when the level of such signal is less than or equal to the voltage $V_{ref}$. Here resistors $R_1$ and $R_{1a}$ are both equal to 10K and resistors $R_2$ and $R_{2a}$ are both equal to 90K. It should be apparent, therefore, that the scale factor networks 18 and 20 provide a 10:1 scale factor for the numerator and denominator signals applied to input lines 14 and 16 respectively.

It is next pointed out that for reasons to become apparent the field effect transistor 34 will periodically decouple resistor $R_3$ from resistor $R_4$ thereby to periodically open one of the two feedback paths of the negative feedback network 29 for a time duration inversely proportional to the magnitude of the denominator signal on input line 16. With such an arrangement the effective feedback impedance associated with amplifier 26 will increase proportionately with the decoupling time duration and hence the gain provided by such amplifier 26 (i.e. the transfer function $Z_T$) will be inversely proportional to the level of the denominator signal on line 16. Hence, the signal level at the output terminal 28, for a given level of numerator signal on input line 14, will decrease proportionately with the level of the denominator signal on input line 16.

Figures 2A, 2B, 2C, 2D:
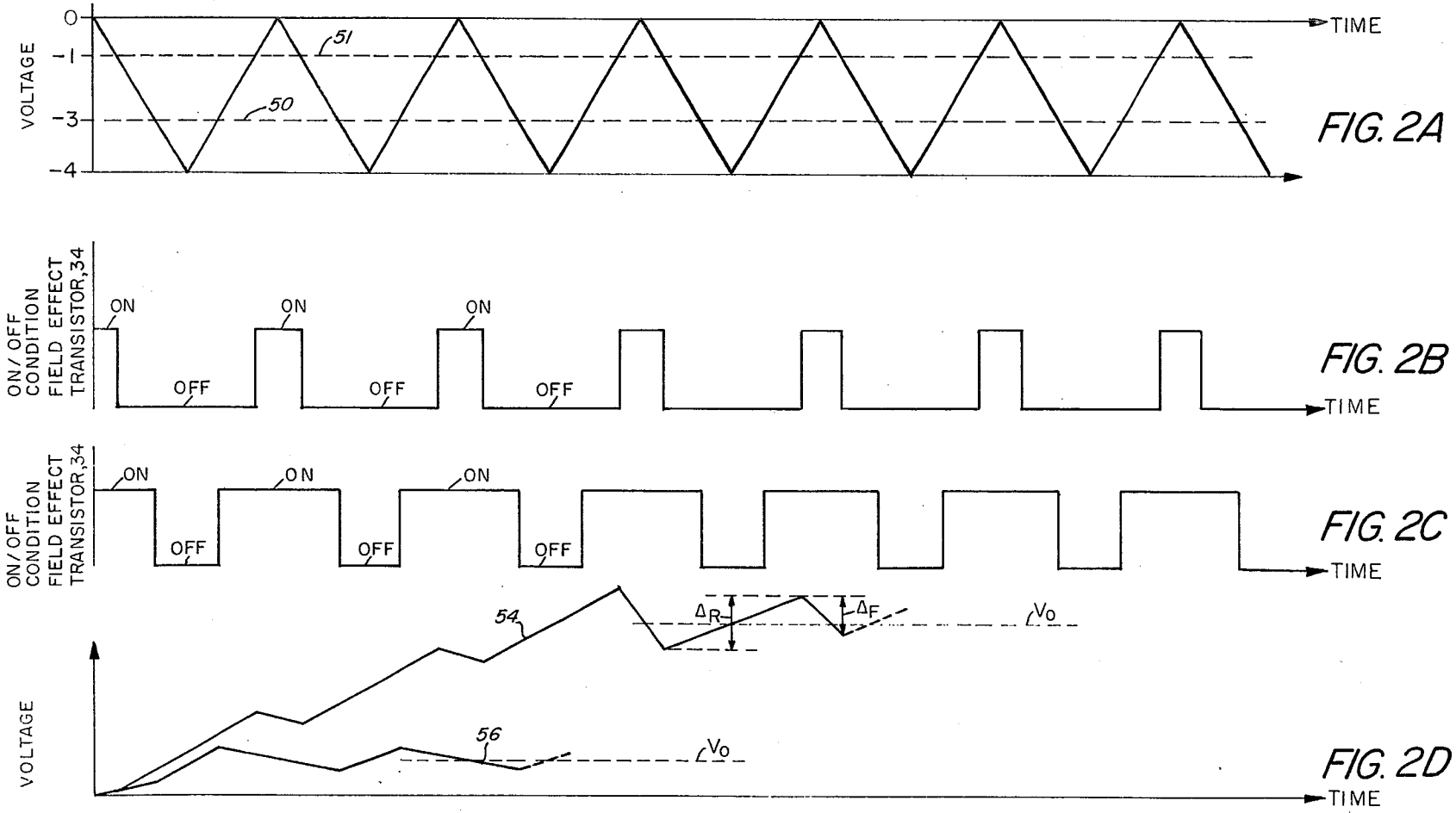
FIGS. 2*a*–2*d* are sketches of various signals, somewhat exaggerated, useful in understanding the operation of the analog divider network shown in FIG. 1.

Referring now also to FIG. 2A, a triangular voltage waveform produced by the triangular waveform generator 46 is shown. Here such voltage varies linearly between a zero volt level to a −4 volt level with a periodicity of 12.5 microseconds. Superimposed on the triangular wave-shaped voltage are dotted lines representative of two voltage levels which may exist at different times at the output of operational amplifier 40. For example, here dotted line 50 represents an operational amplifier 40 output voltage of −3 volts and dotted line 52 represents an operational amplifier 40 output voltage of −1 volt. As described, the voltage at the output of operational amplifier 40 is proportional to the level of the denominator signal applied to input line 16 with either a 1:1 or 10:1 scaling. When the level of the signal at the output of operational amplifier 40 is equal to or more neggative than the level of the signal produced by the triangle waveform generator 46 the field effect transistor 34 is in an "on" condition, and when the level of the signal at the output of operational amplifier 40 is less negative than the signal produced at the output of triangle waveform generator 46 such field effect transistor 34 is in an "off" condition.

FIG. 2b shows the "on"/"off" conditions of the field effect transistor 34 with a voltage level of −1 applied to terminal 42 and FIG. 2C shows the "on"/"off" condition of field effect transistor 34 with a voltage of −3 volts at output terminal 42. When the field effect transistor 34 is in the "on" condition, the resistors $R_3$ and $R_4$ are coupled one to the other and when such field effect transistor is in the "off" condition the resistors $R_3$ and $R_4$ are decoupled one from the other. Further, the "on"/"off" condition associated with field effect transistor 34 is inverse from the "on"/"off" condition associated with field effect transistor 36. Therefore, when field effect transistor 34 is in an "on" condition field effect transistor 36 is in an "off" condition and likewise when field effect transistor 34 is on the "off" condition field effect transistor 36 is on the "on" condition thereby coupling the output terminal 28 to ground through resistor $R_3$ and field effect transistor 36.

It is readily apparent, then, that the ratio of the "off" time of field effect transistor 34 to the period of the triangle waveform, here 12.5 microseconds, is inversely proportional to the level of the signal at output line 42 of operational amplifier 40 (and hence the level of the denominator signal on input line 16) because of the periodicity and linearity of the triangular waveform as seen by comparing FIG. 2*b* with FIG. 2c.

One way of understanding the operation of the analog divider network 10 is as follows: As is known, the amount of feedback current flowing into the input node of an operational amplifier, when a steady state condition has been reached, is substantially equal to the amount of input current supplied to such input node by the input signal applied to the amplifier. The feedback current is proportional to the feedback voltage impressed across the feedback impedance connected in shunt around the operational amplifier. The effect of the "on"-"off" operation of the field effect transistor 34 is then to time average the feedback current in accordance with the level of the denominator signal applied to input line 16. For example, the feedback current $I_{FB}$ may be expressed as:

$$I_{FB} = (E_{OUT}/Z_{FB})\ (\text{Duty Factor}) \qquad \text{Eq. (1)}$$

where:

$E_{OUT}$ is the signal produced at the output of the operational amplifier 26;

$Z_{FB}$ is the feedback impedance; and

Duty Factor is the ratio of the "on" time of field effect transistor 34 to the period of the triangle waveform.

Further, the duty factor is proportional to the level of the denominator signal, $E_D$, on input line 16. Hence, from Eq. (1)

$$I_{FB} = (E_{OUT}/R_{FB})\ (K)\ (E_D) \qquad \text{Eq. (2)}$$

where $K$ is a proportionality constant.

Since, in a steady state condition, the input current, $I_N$, supplied to the operational amplifier 26 is equal to the ratio of the voltage of such input signal thereto (i.e. the numerator signal $E_N$) to the input impedance of such amplifier (i.e. $R_{IN}$) (either $R_1$ or $R_1 + R_2$) and since $I_{IN} = -I_{FB}$, in such steady state condition, then $$E_{OUT} = -(R_{FB}/R_{IN} \cdot K)\ (E_N/E_D) \propto -(E_N/E_D) \qquad \text{Eq. (3)}$$

In FIG. 2D curve 54 shows the signal at the output of operational amplifier 26 (i.e. output terminal 28) for a −1 volt level applied to the duty factor generator 44 by operational amplifier 40 (i.e. at output terminal 42) and curve 56 shows the output of operational amplifier 28 for a −3 volt of signal applied to the duty factor generator by operational amplifier 40 (i.e. at terminal 42). As shown, the signal at output terminal 28 of the operational amplifier 26 for both a −1 volt and −3 volt signal applied to terminal 42 are initially substantially identical. However, when the field effect transistor 34 goes from the "on" condition to the "off" condition the signal at the output terminal 28 of operational amplifier 26 increases rapidly at a rate limited by the value of the capacitor 30. Here such capacitor has a value of 560 PF. When the field effect transistor 34 turns "on" the rate of increase in the voltage at the output terminal 28 decreases because of the presence of the feedback resistors $R_3$ and $R_4$. The process continues until a steady state condition is reached; that is, when the incremental rise in voltage, $\Delta_R$, is equal to the incremental fall in voltage, $\Delta_F$. The output signal at terminal 28 then is a ripple shaped voltage having an average level $V_o$. Such ripple is removed by low pass filter 39. The output of low pass filter 39 then, in the steady state condition, is a signal having a level proportional to the ratio of the level of the input signal on line 14 to the level of the input signal on line 16. Referring to curve 56 in FIG. 2D, it is seen that with a −3 volt signal applied to the duty factor generator 44 the signal produced at the output of operational amplifier 26 will, in the steady state condition, have a level lower than that with a −1 volt signal applied to the duty factor generator 44. Therefore, it is now evident that for a given numerator signal on input line 14 the just described circuit operates to produce at its output 12 a signal which is inversely proportional to the denominator signal which is applied to input line 16. Therefore, in a monopulse receiver application, the azimuth (or elevation) signal channel would be coupled to input line 14, and the sum channel would be coupled to input line 16.

Having described a preferred embodiment of this invention, it is evident that other embodiments incorporating its concepts will become readily apparent to one of skill in the art. It is felt, therefore, that this invention should not be restricted to its disclosed embodiment but rather should be limited only by the spirit and scope of the appended claims.

What is claimed is:

1. An analog divider network, comprising:

a. an operational amplifier having an input terminal coupled to a first analog signal and an output terminal;

b. a switching network;

c. an electrical impedance serially coupled to the switching network, such electrical impedance and switching network being coupled between the input terminal and the output terminal;

d. means, including a triangular waveform generator, and a comparator network having one input coupled to the triangular waveform generator and a second input fed by the analog signal and an output coupled to the switching network for actuating the switching network to periodically decouple the electrical impedance from the input terminal and the output terminal for a time duration inversely proportional to the magnitude of a second analog signal;

e. a first variable electrical impedance means, coupled between the first analog signal and the input terminal of the operational amplifier, for changing the electrical impedance thereof in accordance with a control signal;

f. a second variable electrical impedance means, similar to the first variable electrical impedance means, coupled between the second analog signal and the comparator network, for changing the electrical impedance thereof in accordance with the control signal;

g. a reference voltage source; and h. means coupled to the reference voltage source and responsive to the second analog signal, for producing the control signal in accordance with the difference between the second analog signal and the reference voltage.

2. The analog divider network recited in claim 1 including additionally a capacitor coupled between the input terminal and the output terminal of the operational amplifier.

3. The analog divider network recited in claim 2 including additionally a low pass filter coupled to the output terminal of the operational amplifier, the output thereof being representative of the ratio of the first analog signal to the second analog signal.

* * * * *